United States Patent [19]

Morris et al.

[11] 4,262,497

[45] Apr. 21, 1981

[54] MULTI-ELEMENT PLEOCHROIC GENSTOMES

[75] Inventors: Robert C. Morris, Ledgewood; E. Wayne O'Dell, Morris Plains, both of N.J.

[73] Assignee: Allied Chemical Corporation, Morris Township, Morris County, N.J.

[21] Appl. No.: 32,430

[22] Filed: Apr. 23, 1979

Related U.S. Application Data

[63] Continuation-in-part of Ser. No. 870,386, Jan. 18, 1978.

[51] Int. Cl.[3] ..... A44C 17/00

[52] U.S. Cl. ..... 63/32

[58] Field of Search ..... 63/32; 350/158

[56] References Cited

U.S. PATENT DOCUMENTS

| | | | |
|---|---|---|---|
| 1,745,607 | 2/1930 | D'Esposito | 63/32 X |
| 2,663,171 | 12/1953 | Boone | 63/32 X |
| 2,699,706 | 1/1955 | Boone | 63/32 X |

OTHER PUBLICATIONS

Kraus et al., "Gems & Gem Materials", Kraus & Slawson, McGraw-Hill, N.Y.C. 1947, pp. 171-173 relied on.

*Primary Examiner*—F. Barry Shay

*Attorney, Agent, or Firm*—James Riesenfeld; Gerhard H. Fuchs

[57] ABSTRACT

Multi-element transparent gemstones comprising pleochroic materials are provided which evidence enhanced colors or other unusual optical properties, based on the pleochroic behavior of the material. Doublet stones, comprising two pleochroic materials, and triplet stones, comprising two pleochroic materials separated by an optical rotator, are described. The multi-element gem may have a rotatably mounted pleochroic element or a rotatably mounted optical rotator.

15 Claims, 2 Drawing Figures

Absorption Spectra Of Alexandrite

MULTI-ELEMENT PLEOCHROIC GENSTOMES

RELATED APPLICATIONS

This is a continuation-in-part of copending application Ser. No. 870,386, filed Jan. 18, 1978.

BACKGROUND OF THE INVENTION

1. Field of the Invention

This invention relates to gemstones and, more particularly, to multiplet gemstones, such as doublets and triplets, which incorporate pleochronic crystals.

2. Description of the Prior Art

Many of the well-known gem minerals are pleochroic. That is, a single piece of such a material exhibits various colors, depending on the direction of viewing and/or the polarization direction of the illuminating light. The fundamental effect involves the polarization direction of the light. The viewing angle dependence in unpolarized light arises from the elimination of light polarized parallel to the viewing direction, since light waves are purely transverse excitations. These effects arise in non-cubic, optically uniaxial or biaxial crystals from the influence of an anisotropic host crystal structure on the transitions between electron energy levels of the impurity ions which give rise to the color.

Well-known gem crystals which exhibit pleochroism to a greater or lesser extent include alexandrite, andalusite, axinite, beryl, chrysoberyl, cordierite, dichroite, emerald, epidote, kyanite, periodot, ruby, sinhalite, spodumene, tourmaline and zoisite.

In the course of cutting crystals of these minerals to obtain faceted gem stones, it is well-known that often one must control the crystallographic orientation of the stone to obtain the desired color in the finished gemstone, or alternatively, that the color of the finished gem may be varied to some extent by varying the crystallographic orientation. This is particularly important, for example, in the faceting of certain types of tourmaline. Such a stone cut with the table (top) facet parallel to the c plane may appear nearly opaque or black, while the same stone cut with the table facet perpendicular to the c plane exhibits a desirable blue or green color. Similarly, certain cordierites may appear nearly colorless in certain orientations and deep blue in others.

Multiplet gemstones have been used in the past for various purposes. For example, D'Esposito in U.S. Pat. No. 1,745,607, issued Feb. 4, 1930, describes doublet stones in which two components of natural beryl are cemented together with a transparent cement incorporating an appropriate coloring agent to produce a composite stone exhibiting the color of emerald. In this way, the refractive properties of beryl, which resemble those of emerald, are combined with the color of the intervening colored cement. However, if an originally pale or colorless beryl is formed into a colored composite gem by means of a colored cement, the resultant composite is pleochroic only to the extent that the original stone was colored, D'Esposito's contrary implication notwithstanding.

Other attempts to alter or control the optical properties of gemstones have been employed. For example, Boone, in U.S. Pat. Nos. 2,663,171 and 2,699,706, issued Dec. 22, 1953 and Jan. 18, 1955, respectively, discloses a variety of combinations of birefringent, polarizing and reflecting layers over and/or under transparent supporting elements. These layers provide rainbow-like interference colors, which Boone refers to in his claims as "variegated." The choice of angle (e.g., 45°) between polarizing and birefringent directions affects the extent of the rainbow effect. The support element generally makes no direct contribution to the color, although Boone does disclose that a dye could be incorporated in the supporting element to modify the interference colors. None of Boone's embodiments provides a gemstone with a "pure color"; i.e., transmission in a narrow wavelength band.

In highly doped natural or synthetic alexandrite, the daylight green color is often obscured by red overtones, especially in thicker sections. Cline et al. in U.S. Pat. No. 3,912,521, issued Oct. 14, 1975, disclose addition of iron as an impurity as a means of improving the daylight green coloration of highly doped synthetic crystals of larger size. However, we have observed that this method is not totally effective.

SUMMARY OF THE INVENTION

The present invention is directed to the improvement or modification of the color displayed by pleochroic materials, either alone or in various combinations, by constructing multi-element gemstones comprising these materials, natural or synthetic. The unique features of this invention result from joining into a multielement gemstone pleochroic elements having different crystal orientations. Since light transmission in these crystals depends in general or crystal orientation, a multiplet comprising elements having different orientations possesses light-transmitting properties, and, consequently, color characteristics, not matched by singlets.

One embodiment of this invention comprises a gemstone including a pleochroic element at each end, wherein each of said end pleochroic elements is contiguous to the adjoining element at a substantially planar mating face, each of said mating faces being substantially parallel to the other and having substantially in its plane a principal optical direction, the principal optical direction in the mating face of the element at one end forming with the principal optical direction in the mating face of the element at the other end an angle within the range of about 20° to 160°, each element being fixedly mounted to the adjoining element.

Each element of a gemstone may be fixedly mounted to the adjoining element. Alternatively, an attractive gemstone also results when a pleochroic element at one end is disposed, relative to the remainder of the gemstone, in continuously variable rotational configuration about an axis normal to its mating face. Constructions comprising an optical rotator element sandwiched by pleochroic elements may also be used to obtain the unique color characteristics of this invention. The optical rotator element may be included in gemstones having all elements in fixed relation to one another or in gemstones having a rotatable pleochroic element at one end.

DETAILED DESCRIPTION OF THE INVENTION

One of the most spectacular of the pleochroic minerals is alexandrite, $BeAl_2O_4$ containing chromium ion ($Cr^{3+}$) as an impurity. It is one of the few trichroic minerals, that is, exhibiting three distinct colors corresponding to the three possible polarization directions of light traveling through its orthorhombic cystal structure. We use the crystal lattice parameter assignment of Farrel et al. in American Mineralogist, 48, 804–810 (1963), where a=0.9404 nm, b=0.5476 nm and c=0.4427 nm. A polished cube of alexandrite containing about 0.05 to 0.1 atom percent chromium substituted for aluminum and having dimensions of about 1 cm on an edge, when viewed in transmission in unpolarized daylight, appears blue or purplish-blue in the a direction, orange or reddish-orange in the b direction and green or reddish-green in the c direction.

Figure 1:
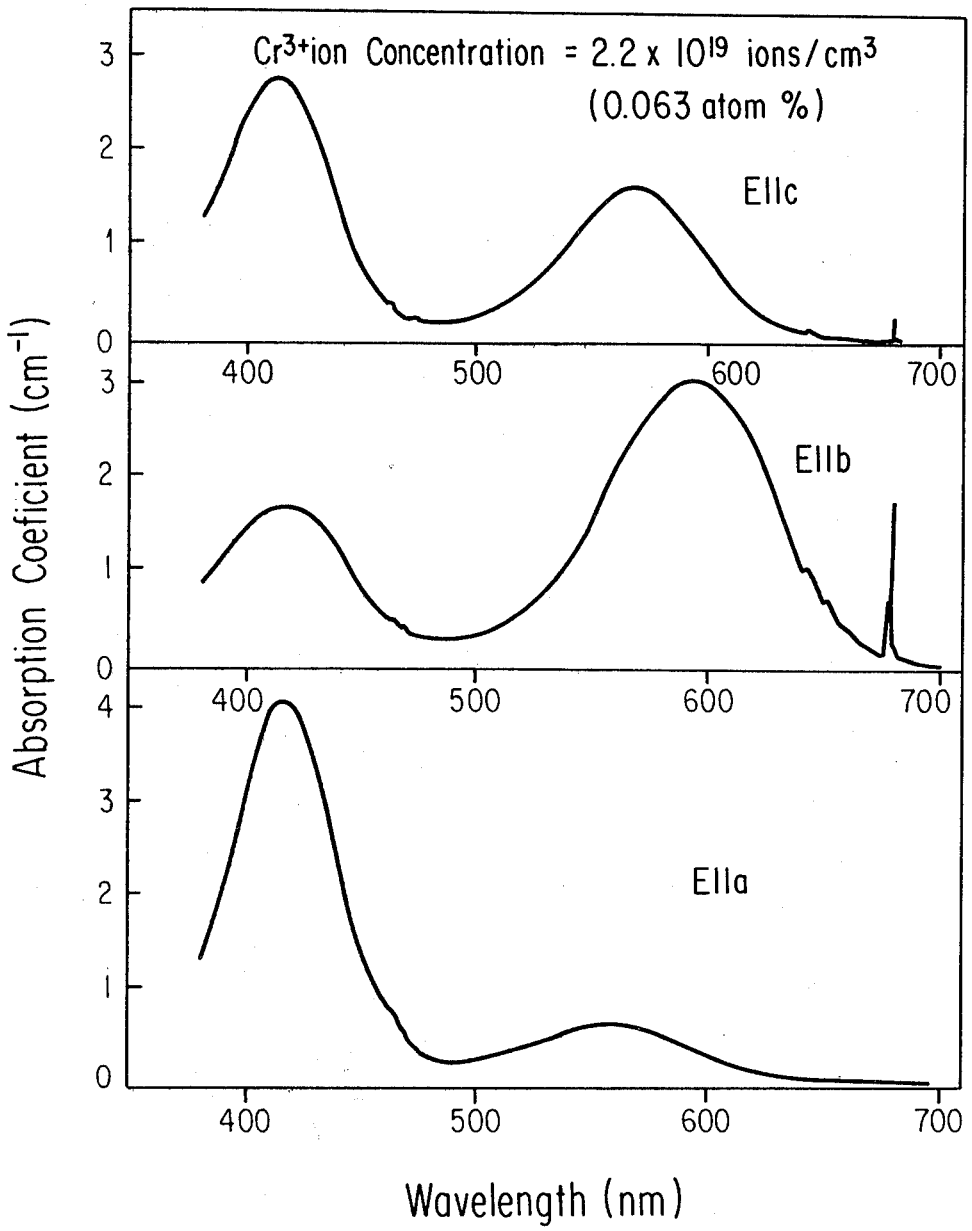
FIG. 1 is a plot of the absorption spectra of synthetic alexandrite in polarized light.

FIG. 1 shows the polarized absorption spectra which give rise to these colors in a typical piece of synthetic alexandrite.

Figure 2:
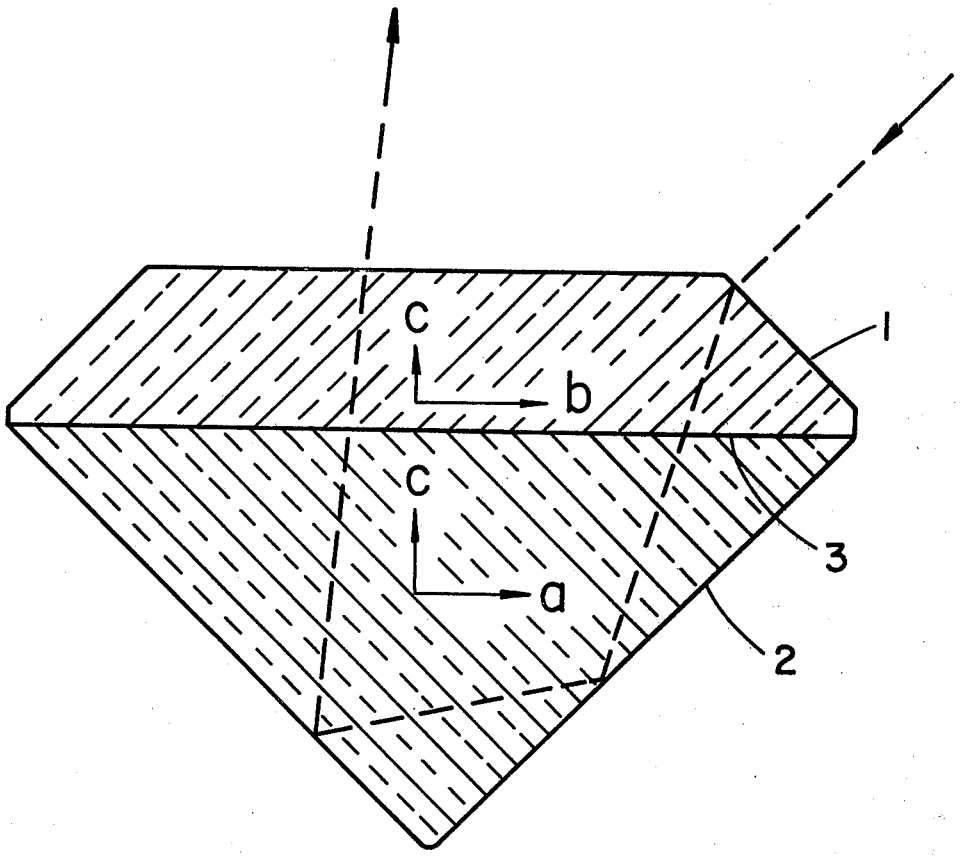
FIG. 2 is a diagrammatic sectional view of a doublet gemstone construction.

FIG. 2 depicts a doublet gemstone of this invention in cross-section. A top or crown portion 1 is disposed in effectively fixed relation to a lower or pavilion member 2. Mating faces 3 of parts 1 and 2 are first lapped and polished prior to bonding portions 1 and 2 together. A suitable bonding agent may be any transparent, colorless, strong adhesive, such as epoxy, Canada balsam, polymethyl methacrylate, cyanoacrylate or other material known in the art. Other agents requiring the application of heat, such as low melting-point glasses or polymers, may also be used. The gem cut may be any of the type usually employed, such as brilliant-cut, emerald-cut, or other cuts employing facets to produce a stone pleasing to the eye. The faceting is generally done such that the planar mating faces lie parallel to the table facet and near the girdle of the stone. Some care may be required during facet grinding and polishing to avoid damage to the glue joint from excessive mechanical force or heat, since the joint may not be as strong or as heat resistant as the gem material.

In accordance with one aspect of the invention, the three crystal directions, a, b and c, of an alexandrite crystal (natural or synthetic) are first determined by means of visual inspection, optical methods or X-ray diffraction. The crystal is then cut in two parallel to the c crystal plane (i.e., perpendicular to the c direction) to form two c-axis plates. The cut mating faces are polished flat and held in contact in their original orientation. One of the pieces is then rotated with respect to the other through an angle $\theta$ about an axis normal to the mating faces. When viewed in transmission along said axis, the stone demonstrates a dramatic change in color from reddish or reddish-green with no rotation to a blue-green color for $\theta$ about 20° to 160°. Intense coloration is produced over the range of about 60° to 120°; accordingly, that range is preferred.

Alternatively, a stone may be cut parallel to the a crystal plane to form two a-axis plates, in which case a relative rotation of a plate by about 90° around an axis normal to the a plane produces a deep pure blue color. The angle of rotation again may vary from about 20° to 160°. Intense coloration is produced over the range of about 60° to 120°; accordingly, that range is preferred. In the case of both c-axis and a-axis plates, the b axis lies in the plane of the mating face. However, if a stone is cut in two perpendicular to the b axis (i.e., a b-axis plate), little or no color change results from rotation. It is sometimes desirable to combine a-axis and c-axis plates in a single multiplet. In this case, the color varies from blue-green, when the b directions of the two plates are at 90° from each other, to violet, when the b directions are parallel.

The principle which underlies this invention may be understood by considering first the light absorption process in general and the absorption process in alexandrite in particular. The intensity of light transmitted by an absorbing medium is given by $$I/I_o = e^{-\alpha x}$$

where $I_o$ is the incident intensity, I the transmitted intensity, $\alpha$ the absorption coefficient, and x the absorber thickness.

Consider a beam of unpolarized white light incident normally on the face of a c-axis plate of alexandrite. Within the plate, the light is resolved into two orthogonally polarized beams, one with E//a and the other with E//b. (No component of E//c is transmitted in the c direction.) Viewed separately (as with a polarizer), the E//b beam appears deep blue-green because of the relatively strong absorption of this beam in the orange spectral region near $\lambda=0.6$ $\mu$m (FIG. 1). The E//a beam, viewed separately, appears yellow because of the absorption of this beam in the blue (between 0.40 and 0.45 $\mu$m). Both beams are transmitted with little absorption in the blue-green ($\lambda \sim 0.5$ $\mu$m) and red ($\lambda > 0.65$ $\mu$m) spectral regions.

the ratio of blue-green light intensity, $I_g$, to red light intensity, $I_r$, is less than one and is given by $$I_g/I_r = e^{-(\alpha g - \alpha r)x},$$

where the subscripts g and r refer to the above-mentioned wavelengths. For small values of x (i.e., for thin sections of crystal) the intensity ratio is nearly 1 and the crystal appears green, because the eye is more sensitive to green light than to red. As the section thickness (or dopant concentration) is increased, however, the ratio becomes smaller, and increasingly thicker crystals appear increasingly red. The undesirable red overtones are enhanced by the high transmission of orange-red light by the E//a beam, which passes appreciable orange-red light even in thick crystals. Of course, the spectrum of transmitted light depends on the spectrum of incident light as well. Thus, a crystal may appear either green under illuminations such as skylight or fluorescent light, which are rich in green, or red under illuminations such as candle-light or incandescent light, which are rich in the red and poor in the blue-green spectral regions. However, with a given illuminant, the blue-green coloration can only be deepened to a very limited extent by increasing the thickness and/or dopant concentration, since the crystal will thereby be made redder, obscuring the blue-green color. We overcome this limitation in the present invention.

If an alexandrite c-axis plate is cut in two along a plane perpendicular to the c direction and the two elements held in the original orientation, the light absorption properties are substantially unchanged from those of the uncut plate. If, however, one element is rotated relative to the other about the c-axis (normal to the mating faces), the light absorption, and consequently the color, changes. We can understand this by considering the effect of the two elements successively. As discussed above, incident light is resolved into two orthogonally polarized beams E//a and E//b. In passing through the first element, orange light ($\lambda \sim 0.6$ $\mu$m) is strongly absorbed in the E//b beam but absorbed very little in the E//a beam (FIG. 1). Blue light ($\lambda \sim 0.40$–$0.45$ $\mu$m) is strongly absorbed in the E//a beam and also absorbed to an appreciable extent in the E//b beam as well. If the second element is rotated 90° relative to the first element, as shown in FIG. 2, then the polarizations of the two transmitted beams are interchanged as they pass from the first element into the second. The beam which was E//a in the first element and was transmitted with relatively low absorption of orange light becomes E//b in the second element and experiences strong orange absorption. As a result, much less orange light is transmitted than was transmitted by the singlet or the "unrotated" crystal. The beam which was E//b in the first element and experienced appreciable blue light absorption becomes E//a and experiences stronger blue absorption. As a result, somewhat less blue light is transmitted than was transmitted by the unrotated sample; however, the reduction in blue transmission is not as great as the reduction in orange light. Blue-green light ($\lambda \sim 0.5$ $\mu$m) is passed with little absorption. The rotated doublet of FIG. 2 thus appears green as greater thickness/dopant concentrations than does a singlet or unrotated doublet. The deep green color achieved by the rotation cannot be achieved in a singlet by any combination of thickness and dopant concentration.

Natural or synthetic alexandrite doublet gem-stones constructed as described above exhibit a strikingly pure daylight green coloration while still possessing the characteristic raspberry or columbine red color of alexandrite when illuminated by incandescent light or light from a wood fire, oil lamp or candle.

In general, optimal coloring of a pleochroic doublet results when the crown contains a higher level of doping than the pavilion, because the crown section of the stone is generally thinner than the pavilion section and therefore requires deeper coloring. For example, the daylight green color of alexandrite can be enhanced most effectively by using two natural or synthetic c-axis plates as described above, in which the crown contains from 1 to 5 times as much chromium as the pavilion. The chromium concentration of the alexandrite crystals should, in general, be in the range of from about 0.005 to 1.0 atom percent substitution of chromium for aluminum ions. The preferred concentrations for gems with final dimensions of about 0.2 to 2 cm in diameter are about 0.06 to 0.6 atom percent in the crown and about 0.02 to 0.2 atom percent chromium in the pavilion.

Furthermore, high doping levels, up to 1.0 atom percent and higher (substitution of $Cr^{3+}$ for $Al^{3+}$ in $BeAl_2O_4$) can be used to obtain very deep green colors. Such high concentration levels inevitably cause serious or complete degradation of the green color in conventional singlet alexandrite gems.

A number of desirable color modifications similar to those described above can be achieved by the method of this invention using other pleochroic crystals instead of or in addition to alexandrite. One such case involves a doublet comprising a plate of c- or a-axis alexandrite cemented to a plate of tourmaline cut so that the tourmaline c axis lies substantially in the plane of the plate. Certain varieties of tourmaline, which exhibit an undesirable yellowish-green color alone, can be made to change to a deep pure emerald green color by rotating the tourmaline plate relative to the alexandrite plate about an axis normal to the plates, the strongest effect occurring when the tourmaline c axis lies parallel to the alexandrite b axis.

Similarly, certain other tourmaline varieties, known collectively as watermelon tourmaline because they contain regions of both red and green color in the same crystal, can be combined in the doublet configuration with the a- or c-axis alexandrite plates in such a way as to increase the depth and contrast of their unique coloration. This is particularly useful in the case of lightly colored material which is otherwise of good quality but appears pale and low in color contrast. Again, the effect is maximized when the tourmaline c axis lies parallel to the alexandrite b axis.

The color of certain varieties of aquarmarine, morganite, beryl and ruby can be adjusted by combining them with dichroic plates of tourmaline or cordierite in doublet configurations as described above, with the rotation angle being adjusted to produce the desired color.

The effects discussed above for a pleochroic doublet can also be produced using an optically active rotator element disposed between two pleochroic elements. This variation relies on the known optical rotatory power or optical activity of $\alpha$-quartz (and certain other compounds of the same crystal structure, such as berlinite) to rotate the polarization directions of light beams traveling in the quartz. A beam of linearly polarized light traveling parallel to the c axis in a crystal of $\alpha$-quartz undergoes a progressive rotation of its plane of polarization, depending on the distance traveled and the wavelength. (Generally, in a given path length, light of short wavelength is rotated more than light of longer wavelength).

An alexandrite-quartz-alexandrite triplet illustrates a preferred embodiment of this aspect of the present invention. It will be recalled that an alexandrite doublet comprising suitably oriented c-axis plates transforms the E//a beam in one element into the E//b beam in the other element, thus causing greater absorption of light in the $\lambda \sim 0.6$ $\mu$m spectral region than would take place without the invention. In the present invention, the rotational transformation is accomplished by the use of a quartz c-axis plate interposed between two plates of similarly oriented alexandrite. The thickness of the quartz plate is chosen to produce a rotation of approximately 90° (thus transforming the E//a beam into the E//b beam) for 80 $\sim 0.6$ $\mu$m. The rotatory power in this region is about 20° per mm, so the required thickness is about 4.5 mm. In practice, we have found that thinner quartz plates (0.5 mm and up) can also be used if the balance of the rotation is accomplished by rotation of one alexandrite element relative to another about an axis normal to its mating faces. As a practical matter, the maximum thickness for a quartz plate employing in triplet gem-stones is about 10 mm. The preferred position of the quartz plate in the finished gem is generally near the girdle. The chromium concentration ranges and ratios discussed above in connection with alexandrite doublets also apply to multiplets which include optical rotators.

EXAMPLES

Example 1

An alexandrite doublet gem was constructed as follows. Two polished c-axis plates of synthetic alexandrite, one containing 0.3 atom percent chromium and the other containing 0.1 atom percent chromium, were cemented together using Devcon 5-minute epoxy glue with a 90° relative rotation, such that the a axis in one plate lay parallel to the b axis in the other plate. After allowing adequate time for the epoxy to cure, the composite was formed into a standard brilliant-cut gem by conventional lapidary diamond grinding and polishing techniques. Using the traditional crown and pavilion angles for alexandrite, the crown plate, containing 0.3 atom percent $Cr^{3+}$, had a final thickness of 1.53 mm, and the pavilion plate, containing 0.1 atom percent $Cr^{+3}$, had a final maximum thickness (at the culet or point) of 4.58 mm. The glued joint in the finished gem was parallel to the table or top facet and at the level of the girdle or widest diameter of the gem. The finished gem had a girdle diameter of 9.8 mm, a total height, from table to culet, of 6.1 mm and a weight of approximately 0.8 g (4 carats). The color of the finished gem was deep green by daylight or fluorescent light and deep raspberry red when illuminated by an incandescent bulb or candlelight.

Example 2

Two standard emerald cut alexandrite gems were produced following the general procedures outlined in Example 1. In this case, both the crown and pavilion elements were c-axis synthetic alexandrite plates containing 0.05 atom percent $Cr^{3+}$. Both stones had final width and length dimensions of 10 and 12 mm, respectively. In the first stone (stone A), the a axis of the pavilion plate was parallel to the width (short dimension) of the finished gem, as was the b axis of the crown plate. In the second stone (stone B), the b axis of the pavilion element and the a axis of the crown element were both parallel to the width dimension; i.e., the reverse of stone A. Both stones appeared raspberry red under incandescent light or candlelight and green in daylight. The daylight tint of stone A, however, was decidedly bluish-green, while that of stone B was more of a pure green.

Example 3

In this example, a doublet combined two different pleochroic materials to produce a unique effect. A dichroic natural andalusite crystal and a crystal of the blue, strongly pleochroic variety of cordierite (also known as iolite or dichroite), were placed together with the surface perpendicular to the orange-appearing direction in the andalusite crystal (containing the optical X direction) contacting the surface perpendicular to the blue-appearing direction in the cordierite crystal (also containing the optical X direction). (The optical X direction is the polarization direction of light with the smallest index of refraction.) Rotation of the elements such that the optical X directions of both crystals were parallel produced a violet color by daylight illumination, which changed to red under incandescent light. Thus, a color change with illumination was produced.

A standard emerald-cut gemstone measuring 6×5 mm was produced from these elements using the general procedures outlined in Example 1. The crown plate was formed from the andalusite crystal with the polished surface perpendicular to the orange-appearing direction in the crystal so that the polished surface contained the optical X direction. The pavilion plate was formed from the cordierite crystal in such a way that the optical X direction of the crystal lay in the plane of the plate. The plates were cemented together so that the optical X directions of both crystals lay parallel in the finished gem and along the long dimension. The finished gem was a pleasing violet color by daylight illumination, changing to red under incandescent light.

Example 4

In this example, a quartz rotator plate was used to accomplish a part of the rotational transformation of polarizations in an alexandrite-quartz-alexandrite triplet. Two cubes of alexandrite, 8 mm on edge, with edges oriented parallel to the a, b and c directions, were placed on either side of a 4 mm thick c-axis $\alpha$-quartz plate such that faces perpendicular to the c axis of the cubes contacted with faces perpendicular to the c axis of the plate. Alignment of the cubes such that their a axes were parallel produced the characteristic green color under daylight illumination and the characteristic raspberry red color under incandescent illumination, when viewed along the c axis.

A standard brilliant-cut gemstone was prepared as follows. A crown plate of c-axis synthetic alexandrite containing 0.15 atom percent chromium was cemented to one side of a 2 mm thick c-axis $\alpha$-quartz plate. To the other side of the quartz plate was cemented a pavilion plate of c-axis synthetic alexandrite containing 0.05 atom percent chromium and oriented with its a axis rotated 45° from the a axis of the crown plate in a direction producing the characteristic color change (the direction of rotation required depends on whether right or left-handed rotating quartz is used). The composite so produced was then fabricated into a 15 mm diameter brilliant-cut gemstone, with the quartz plate parallel to the table facet and centered at the girdle plane. The resulting gem appeared the characteristic green color in daylight when viewed at right angles to the tablet facet, but changed to reddish-orange when rotated by a small angle. Under incandescent illumination, there was a decided color change to the characteristic raspberry red color.

We claim:

1. A multi-element transparent gemstone comprising an optically active rotator element disposed between two pleochroic elements, each element being fixedly mounted to the adjoining element said elements being arranged, relative to each other, in a manner so that the color displayed by individual ones of said pleochroic elements is modified in the combination at least through the action of said rotator element.

2. The gemstone of claim 1, including a pleochroic element at each end, wherein each of said end pleochroic elements is contiguous to the adjoining element at a substantially planar mating face, each of said mating faces being substantially parallel to the other and having substantially in its plane a principal optical direction, the principal optical direction in the mating face of the element at one end being substantially aligned with the principal optical direction in the mating face of the element at the other end.

3. The gemstone of claim 7, wherein said optically active rotator comprises alpha-quartz.

4. The gemstone of claim 3, wherein said alpha-quartz is cut perpendicular to its c axis and has a thickness of at least about 0.5 mm.

5. A multi-element transparent gemstone comprising at least two pleochroic elements having different crystal orientations, including a pleochroic element at each end, wherein each of said end pleochroic elements is contiguous to the adjoining element at a substantially planar mating face, each of said mating faces being substantially parallel to the other and having substantially in its plane a principal optical direction, the principal optical direction in the mating face of the element at one end forming with the principal optical direction in the mating face of the element at the other end an angle within the range of about 20° to 160° whereby the color displayed by individual ones of said pleochroic elements is modified in the combination, each element being fixedly mounted to the adjoining element.

6. The gemstone of claim 5, wherein the principal optical directions in the planes of the mating faces form with each other an angle within the range of about 60° to 120°.

7. The gemstone of claim 5, wherein said pleochroic elements are independently selected from the group consisting of alexandrite, andalusite, axinite, beryl, chrysoberyl, cordierite, dichroite, emerald, epidote, kyanite, peridot, ruby, sinhalite, spodumene, tourmaline, and zoisite.

8. The gemstone of claim 7, wherein said pleochroic elements are independently selected from the group consisting of alexandrite and tourmaline.

9. The gemstone of claim 5 comprising two pleochroic elements.

10. The gemstone of claim 9, wherein said pleochroic elements comprise alexandrite which contains about 0.005 to 1.0 atom percent chromium in place of aluminum, the mating face of each said element having substantially in its plane the b crystal axis of that element.

11. The gemstone of claim 9, wherein one element comprises tourmaline cut with its mating face having substantially in its plane the c crystal axis and the other element comprises alexandrite cut with its mating face having substantially in its plane the b crystal axis.

12. A multi-element transparent gemstone comprising at least two pleochroic elements having different crystal orientations, including a pleochroic element at each end, wherein each of said end pleochroic elements is continuous to the adjoining element at a substantially planar mating face, each of said mating faces being substantially parallel to the other and having substantially in its plane a principal optical direction, one of said end pleochroic elements being disposed, relative to the remainder of the gemstone, in continuously variable rotational configuration about an axis normal to its mating face.

13. The gemstone of claim 12, wherein said pleochroic elements are independently selected from the group consisting of alexandrite, andalusite, axinite, beryl chrysoberyl, cordierite, dichroite, emerald, epidote, kyanite, peridot, ruby, sinhalite, spodumene, tourmaline, and zoisite.

14. The gemstone of claim 12 additionally comprising an optically active rotator element disposed between two pleochroic elements.

15. The gemstone of claim 14, wherein said optically active rotator element comprises alpha-quartz.

* * * * *

UNITED STATES PATENT AND TRADEMARK OFFICE

CERTIFICATE OF CORRECTION

PATENT NO. : 4,262,497

DATED : April 21, 1981

INVENTOR(S) : Robert C. Morris and E. Wayne O'Dell

It is certified that error appears in the above-identified patent and that said Letters Patent are hereby corrected as shown below:

Col. 3, line 4 "cystal" should be --crystal--
Col. 4, line 28 "the" should be --The--
Col. 5, line 27 "gem-stones" should be --gemstones--
Col. 6, line 39 "invention" should be --variation--
Col. 6, line 45 "80~0.6μm" should be --λ~0.6μm--
Col. 6, line 54 "gem-stones" should be --gemstones--
Col.8, line 11 "axis" should be --axes--
Col. 8, line 12 "with" should be --the--

IN THE CLAIMS
In Claim #3
Col. 8, line 57 "7" should be --2--

In Claim #12
Col. 10, line 10 "continuous" should be --contiguous--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*